US005564965A

United States Patent [19]

Tanaka et al.

[11] Patent Number: 5,564,965

[45] Date of Patent: Oct. 15, 1996

[54] POLISHING MEMBER AND WAFER POLISHING APPARATUS

[75] Inventors: Kouichi Tanaka; Hiromasa Hashimoto; Fumio Suzuki, all of Fukushima-ken, Japan

[73] Assignee: Shin-Etsu Handotai Co., Ltd., Tokyo, Japan

[21] Appl. No.: 355,212

[22] Filed: Dec. 9, 1994

[30] Foreign Application Priority Data

Dec. 14, 1993 [JP] Japan ..... 5-342940
Dec. 14, 1993 [JP] Japan ..... 5-342941

[51] Int. Cl.[6] ..... B24B 5/00

[52] U.S. Cl. ..... 451/287; 451/285; 451/526; 451/533

[58] Field of Search ..... 451/41, 283, 285, 451/287, 397, 398, 533, 526, 527

[56] References Cited

U.S. PATENT DOCUMENTS 5,212,910 5/1993 Breivogel et al. ..... 451/287
5,257,478 11/1993 Hyde et al. .

FOREIGN PATENT DOCUMENTS 0465868 6/1991 European Pat. Off. ..... B24D 3/00
0465865 6/1991 European Pat. Off. .
0555660 1/1993 European Pat. Off. ..... B24B 37/04
2257382 1/1993 United Kingdom ..... B24B 37/04

OTHER PUBLICATIONS

Patent Abstracts of Japan, v14,n502,E–0997, Aug. 20, 1990, Hitachi Cable Ltd.
Patent Abstracts of Japan, v11,n398,C–466, Jul. 11, 1987, Kanebo, Ltd.
Patent Abstracts of Japan, v8,n107,E–245, Feb. 4, 1984, Nippon Denki KK.

*Primary Examiner*—D. S. Meislin
*Assistant Examiner*—Eileen Morgan
*Attorney, Agent, or Firm*—Ronald R. Snider

[57] ABSTRACT

A polishing apparatus is provided which can effect surface-based polishing of a wafer without causing the wafer to produce an undulation or peripheral protrusion. A sheetlike polishing member 5 constructed by superposing a foam sheet 2 containing minute closed cells in a web of chloroprene rubber and a velour type non-woven fabric (polishing cloth 3) is attached fast to the surface of a polishing table 1. The polishing member is capable of polishing a given wafer while maintaining the uniformity of thickness of the wafer or an oxide film formed on the surface of the wafer because, during the application of pressure by a pressing member 14, the polishing pressure is uniformly distributed throughout the entire rear surface of the wafer and the polishing member is bent in conformity with the global rises and falls in the wafer surface.

8 Claims, 11 Drawing Sheets

POLISHING MEMBER AND WAFER POLISHING APPARATUS

BACKGROUND OF THE INVENTION

1. Field of the Invention

This invention relates to a polishing member and a polishing apparatus for polishing wafers and more particularly to a polishing member and a polishing apparatus which are adapted for the technique of planarization machining aimed at conferring improved flatness on semiconductor devices.

2. Description of the Prior Art

In consequence of the advance of the trend of semiconductor devices toward greater integration and larger capacity, the technique for imparting minimized diameters to wires and the technique for increasing the number of component layers of multilayer wires have been acquiring growing importance.

When a wire has a minimized diameter, the ability of an insulating film to be superposed on the wire or the ability of the wire to be covered with the insulating film is degraded because the end face of the wire inevitably gains in precipitousness. When a multilayer wire has an increased number of component layers, it betrays heavy surface irregularities because of accumulation of irregularities on the underlying layers or on the insulating film. When a wire is to be superposed on the surface of this multilayer, the superposition is attained only with inferior wiring precision because the stepper is no longer focussed accurately on the irregular wire surface. In any event, these surface irregularities tend to cause breakage in the wire and impair the reliability of a semiconductor device using the multilayer wire.

Various techniques for flattening wire surfaces have been developed for the purpose of solving this problem. The glass flow method, for example, aims to provide a wire with a flattened surface by forming a glass film such as of PSG, BPSG, etc. by the CVD and then heating the glass film at a temperature in the range of from 800° to 1,100° C. thereby generating viscous flow of the glass film. Though this method is simple as a process, it is at a disadvantage in limiting the material to be used for the wire because of the high temperature which is required for heating the glass film and, therefore, is not tolerated by aluminum. Various other methods have been developed. They have both merits and demerits. None of them perfectly fits the purpose of surface smoothing under consideration.

In recent years, the researches after a method for producing a smooth surface by utilizing the technique of wafer polishing has been under way with a view to overcoming this discouraging state of prior art. Specifically, in the process of manufacture of a semiconductor device, the researches are aimed at the application of the wafer polishing technique to the technique of planarization machining capable of exalting the flatness of the semiconductor device, namely the utilization of the technique as a measure to flatten the parts projecting from the surface of a silicon oxide film in conformity to the wires distributed on a wafer. Heretofore, this wafer polishing technique has been primarily intended to impart a uniform thickness to a wafer throughout the entire area thereof and, therefore, has been developed for the purpose of preferentially removing parts of an increased wall thickness from a wafer.

In the planarization machining technique for the manufacture of a semiconductor device, however, the necessity of developing the surface-based polishing technique, i.e. a technique which enables a wafer in the process of machining (hereinafter referred to as "wafer W"), even when the cross-sectional shape thereof happens to contain differences between parts of a large wall thickness and parts of a small wall thickness as shown in FIG. 7, to be so polished that the oxide film on the surface of the wafer W may be excoriated in an equal amount and the wafer W may assume such a cross-sectional shape as is illustrated in FIG. 8, has been finding widespread approval.

The reason for this necessity is that the wafer polishing technique has been heretofore developed for the purpose of preferentially removing parts of an increased wall thickness from a given wafer thereby attaining the impartation of a uniform wall thickness to the wafer throughout the entire area thereof. The surface-based polishing technique specifically consists in removing from a silicon substrate 31 illustrated in FIG. 7 protrusions 33 of oxide film, namely differences of level occurring in an oxide film 32 (interlayer dielectric) on the silicon substrate 31, and at the same time permitting the oxide film 32 to acquire a uniform thickness. In FIG. 7 and FIG. 8, 34 stands for an element and 35 for a wire distributed. In these diagrams, the global rises and falls in the wafer W are exaggerated for the sake of convenience of illustration.

Incidentally, in the wafer polishing apparatus adapted for the polishing technique mentioned above, commercially available polishing cloth is generally used in its unmodified form as a polishing member to be disposed on a polishing table. The polishing cloth is known in the two types, namely the suede type and the velour type. These two types are selectively used to suit the purpose of polishing.

The suede type polishing cloth is a man-made leather for the industrial application so to speak. It is composed of a substrate layer of three-dimensionally constructed non-wovenfabric formed of synthetic fibers and a special synthetic rubber and a surface layer having numerous minute pores fonned in such resin as polyurethane excelling in abrasion resistance. The velour type polishing cloth is a so-called monolayer non-woven fabric, namely a three-dimensionally constructed porous sheetlike material.

For the polishing of a wafer is adopted a method which comprises pressing a wafer held fast with a retaining member under prescribed pressure against an polishing cloth fixed on the polishing table and polishing the wafer while feeding a suitable polishing agent onto the polishing cloth.

The polishing cloth which is used for primary polishing and secondary polishing of a wafer is constructed in such a hard texture as minimizes the possible dispersion of wall thickness of the polished wafer and is designed to remove by polishing the parts of a large wall thickness preferentially. With the wafer polishing apparatus which is provided with such a polishing cloth as described above, therefore, the surface-based polishing mentioned above is attained only with difficulty.

For the purpose of eliminating this difficulty, a polishing apparatus illustrated in FIG. 13 and a "mirror polishing apparatus for a wafer" disclosed in JP-A-05-69,310 have been proposed, for example.

The polishing apparatus of FIG. 13 comprises a pressing member 71 made of a hard material, a soft mounting pad 72 attached as a wafer retaining plate to the lower surface of the pressing member 71, all annular template 73 disposed on the lower surface of the pad 72, and a soft polishing cloth 75 disposed on the surface of a polishing table 74. The polishing apparatus set forth in JP-A-05-69,310 mentioned above, as illustrated in FIG. 14, comprises a soft elastic film 51 having a plane for retaining a wafer W, an annular barrel part 52 having the elastic film 51 attached thereto with uniform tension, and fluid feed means 53 for feeding a fluid for adjusting the pressure exerted on the wafer W to the surface of the elastic film 51 opposite to the surface thereof holding the wafer W thereon. In the diagram, 54 stands for a rotating shaft, 55 for an annular guide plate (template) attached to the lower surface of the elastic film 51, and 56 for a stationary polishing table.

Incidentally, the amount of the wafer to be removed by polishing depends largely on the polishing pressure. For the surface-based polishing technique mentioned above, therefore, it is extremely important that the wafer is polished so as to uniformize the amount of removal due to polishing throughout the entire surface of the wafer as illustrated in FIG. 15 (b) by uniformizing the distribution D of the polishing pressure exerted on the rear surface of the wafer W (equally distributed load) as illustrated in FIG. 15(*a*). In FIG. 15(*a*), 61 stands for a wafer retaining member and 61 for an polishing cloth.

The polishing apparatus illustrated in FIG. 13, in spite of the advantage in simplifying the construction for retention of a wafer, succumbs readily to the influence of dispersion of the characteristic properties (thickness, elasticity, and inclination toward deterioration) and does not easily attain uniformization of polishing pressure. As respects the distribution D of polishing pressure, therefore, the polishing pressure within the wafer surface lacks uniformity as shown in FIG. 16(*a*) and the polished wafer W produces an undulation A as shown in FIG. 16(*b*) when the mounting pad to be used has a dispersed thickness, the polished wafer W produces a protrusion B in the peripheral part thereof as shown in FIG. 17(*b*) when the polishing pressure is unduly small in the outer circumferential part of the wafer as shown in FIG. 17 (*a*), and the polished wafer W produces a peripheral sag C as shown in FIG. 18(*b*) when the polishing pressure is unduly large in the outer peripheral part of the wafer as shown in FIG. 18(*a*).

The polishing apparatus disclosed in JP-A-05-69,310 mentioned above is required to set the distance between the lower surface of the outer edge part of the elastic film 51 and the upper surface of the polishing table 56 accurately within a prescribed range for the purpose of curbing the occurrence of an abnormal shape in the circumferential part of the wafer as shown in FIG. 17(*b*) and FIG. 18(*b*) because the elastic film 51 serving to seal the annular barrel part 52 abounds in flexibility.

If this distance is unduly large, the polished wafer W will assume such a cross-sectional shape as shown in FIG. 17(*b*) because the central part of the elastic film 51 is caused to form a convex surface by the pressure of fluid. If the distance is unduly small, the polished wafer W will be made to assume such a cross-sectional shape as shown in FIG. 18(*b*) by the load exerted downwardly by the barrel part 52 or the pressure of fluid exerted between the wafer W and the barren part 52. In either case, the oxide film of the wafer cannot retain the uniformity of thickness.

SUMMARY OF THE INVENTION

This invention has been produced with a view to eliminating the drawbacks of prior art mentioned above. It is a primary object of this invention to provide a polishing member and a wafer polishing apparatus which are capable of implementing surface-based polishing without compelling a wafer to produce anundulating surface, a peripheral protrusion, or a peripheral sag.

The first aspect of this invention recites a polishing member disposed on a polishing table, characterized by having a foam sheet of soft rubbery elastomer and a polishing cloth laminated.

The second aspect of this invention recites a polishing member disposed on a polishing table, characterized by having a flexible sheetlike member of a hard thin sheet interposed between a foam sheet of soft rubbery elastomer and a polishing cloth.

The third aspect of this invention recites a polishing member according to the first or second aspect of this invention, characterized in that the foam sheet is a closed-cell foam which is made of natural rubber, synthetic rubber, or thermoplastic elastomer and vested with flexibility by the gas in the cells thereof and the foam sheet has (1) a thickness in the range of from 0.2 to 2 mm, (2) a cell diameter in the range of from 0.05 to 1 mm, (3) a cell content (the ratio of the total volume of cells to the total volume of the foam sheet) in the range of from 70 to 98%, and (4) a compressive elastic modulus in the range of from 10 to 100 g/mm$^2$.

The fourth aspect of this invention recites a polishing member according to the first or second aspect of this invention, characterized in that the polishing cloth is of the suede type or of the velour type.

The fifth aspect of this invention recites a wafer polishing apparatus, characterized by having a foam sheet of soft rubbery elastomer superposed fast on the surface of a polishing table and having a polishing cloth laminnated on the foam sheet.

The sixth aspect of this invention recites a wafer polishing apparatus, characterized by having a foam sheet of soft rubbery elastomer superposed fast on the surface of a polishing table, having a flexible sheetlike member of hard thin sheet laminated on the foam sheet, and having a polishing cloth laminated on the flexible sheetlike member.

The seventh aspect of this invention recites a wafer polishing apparatus according to the fifth or sixth aspect of this invention, characterized in that the foam sheet is a closed-cell foam which is made of natural rubber, synthetic rubber, or thermoplastic elastomer and vested with flexibility by the gas in the cells thereof and the foam sheet has (1) a thickness in the range of from 0.2 to 2 mm, (2) a cell diameter in the range of from 0.05 to 1 mm, (3) a cell content (the ratio of the total volume of cells to the total volume of the foam sheet) in the range of from 70 to 98%, and (4) a compressive elastic modulus in the range of from 10 to 100 g/mm$^2$.

The eighth aspect of this invention recites a wafer polishing apparatus according to the fifth or sixth aspect of this invention, characterized in that the polishing cloth is of the suede type or of the velour type.

BRIEF DESCRIPTION OF THE DRAWINGS

The invention will be better understood and the objects and features thereof other than those set forth above will become apparent when consideration is given to the following detailed description thereof, which makes reference to the annexed drawings wherein.

DETAILED DESCRIPTION OF THE PREFERRED EMBODIMENTS

Figure 1:
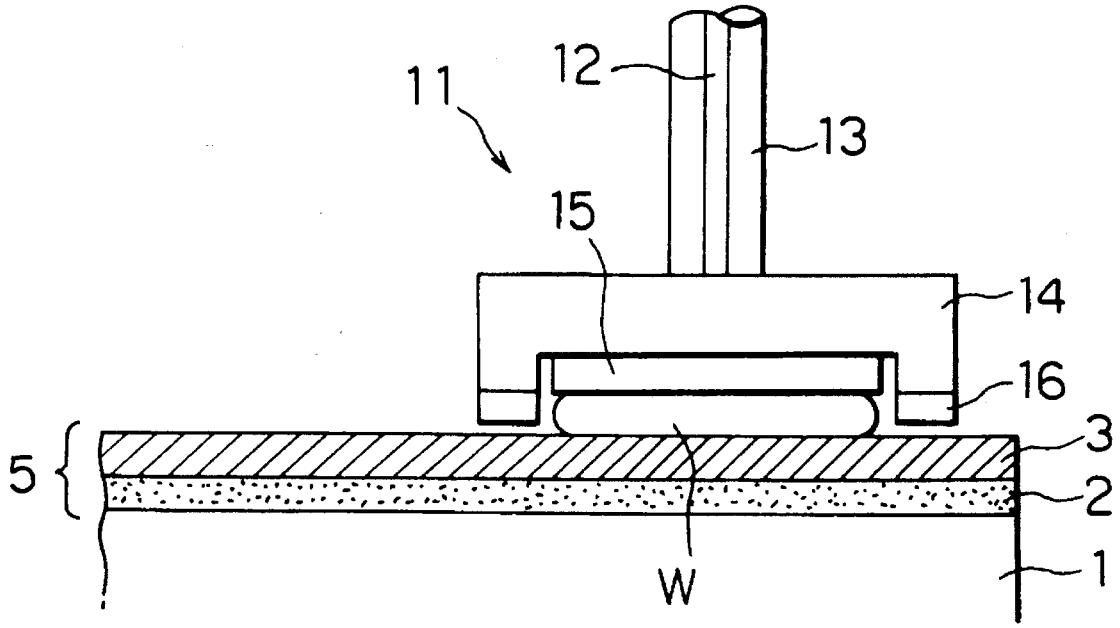
FIG. 1 is a cross section schematically illustrating the essential part of one example of the wafer polishing apparatus according to this invention.

As the foam sheet for use in the polishing member of this invention, it is desirable to use a closed-cell foam which is recited in the third aspect of this invention. As concrete examples of the material usable effectively for the closed-cell foam, natural rubbers, synthetic rubbers such as chloroprene rubber, ethylene-propylene rubber, and butyl rubber, and thermoplastic elastomers of the styrene type, ester type, and urethane type may be cited. The hardness (as measured on the Shore A scale) of natural rubber, synthetic rubber, or thermoplastic elastomer (in unfoamed state) is desired to be in the range of from 30 to 90.

The elasticity of the foam sheet is the sum of the elasticity of the material itself and the elasticity of the gas entrapped in the foam. Owing to the visvo-elastisity inherent in the material, the elasticity of the foam sheet is inevitably prone to deterioration by aging. The gas entrapped in the foam undergoes virtually no deterioration by aging because the gas law (volume×pressure=constant) substantially holds good for the gas entrapped in the foam. Further, when the rigidity of the material for the foam itself is lowered by such a measure as thinning the cell walls of the foam, the nature of the gas in the foam manifests itself conspicuously and lends itself to soften the foam sheet as a whole. Even when the cell walls are thinned, the individual beads of gas entrapped in the foam cooperate in preventing the foam sheet from being crushed while in use.

The foam sheet, therefore, is a material which is at an advantage in utilizing the nature of the gas in the closed cells of the foam for decreasing the compressive elastic modulus and curbing the deterioration by aging.

The thickness of the foam sheet is desired to be in the range of from 0.2 to 2 mm. If the thickness is less than 0.2 mm, the foam sheet will fail to deform in conformity with the contour of the wafer. If the thickness exceeds 2 mm, the foam sheet in the process of polishing will tend to produce local deformations and the wafer will not be polished with high accuracy.

The diameter of the cells in the foam sheet is desired to be in the range of from 0.05 to 1 mm. If the cell diameter is less than 0.05 mm, the foam sheet will fail to acquire a high cell content as desired or retain the cushioning property as required. If it exceeds 1 mm, the foam sheet will not easily produce a uniform deformation under pressure.

The cell content of the foam sheet is desired to be set in the range of from 70 to 98%. If the cell content is less than 70%, the foam sheet will be deficient in the cushioning property. If it exceeds 98%, the foam sheet will not easily tolerate protracted and repeated use because the ratio of the material forming the cell walls of the foam is unduly small.

The compressive elastic modulus of the foam sheet is desired to be set in the range of from 10 to 100 g/mm$^2$. If the compressive elastic modulus is less than 10 g/mm$^2$, the foam sheet will not be allowed to enjoy any improvement of softness due to the action of the gas in the cells. If it exceeds 100 g/mm$^2$, the foam sheet will gain excessively in hardness and will no longer manifest any appreciable cushioning property.

As the flexible sheetlike member of hard thin sheet which is contemplated by this invention, thin sheets of hard plastics, hard rubber, and metals are usable, for example.

As hard plastics, such thermosetting resins as epoxy resin and phenol resin and such heat-resistant hard resins as polyethylene terephthalate, polybutylene telephthalate, polyimide, and polysulfones are advantageously used. These hard plastic materials may be used as reinforced with glass fibers, carbon fibers, synthetic fibers or with woven fabrics or non-woven fabrics of such fibers.

The flexible sheetlike member which is made of hard plastics or hard rubber (inclusive of the type reinforced with such fibers as mentioned above) is desired to have a thickness in the range of from 0.1 to 1.0 mm in order that it may infallibly acquire flexibility necessary for sheet.

As the metal, various species of steel represented by stainless steel are advantageously used. The flexible sheetlike member which is made of such steel is desired to have a thickness in the range of from 0.05 to 0.2 mm in order that it may infallibly acquire flexibility necessary for sheet.

Figure 2:
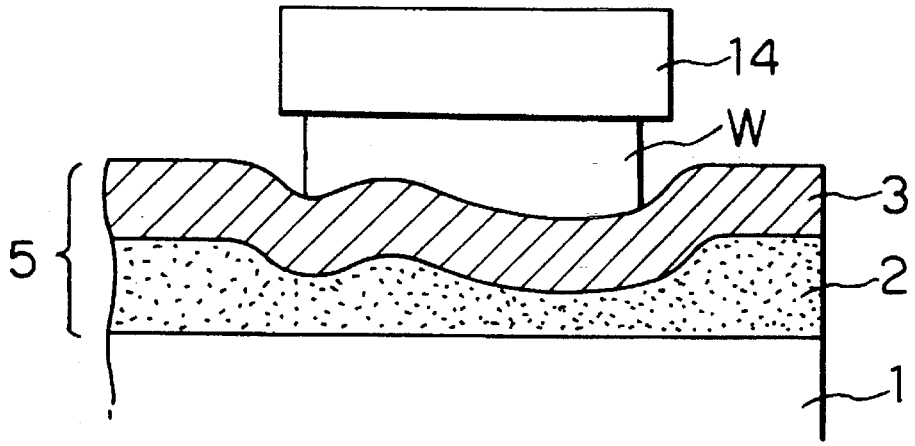
FIG. 2 is an explanatory cross section illustrating the action of the wafer polishing apparatus of FIG. 1.

The wafer polishing apparatus recited in the fifth aspect of this invention is so constructed as to have a polishing cloth 3 superposed on a polishing table 1 through the medium of a foam sheet 2 of soft rubbery elastomer as illustrated in FIG. 2. When a wafer W is pressed down by a pressing member 14, therefore, the wafer can be polished with the polishing pressure uniformly distributed throughout the entire rear surface of the wafer and a polishing member 5 bent in conformity with the global rises and falls of the wafer surface (by absorbing the dispersion of wall thickness of the wafer).

Figure 4:
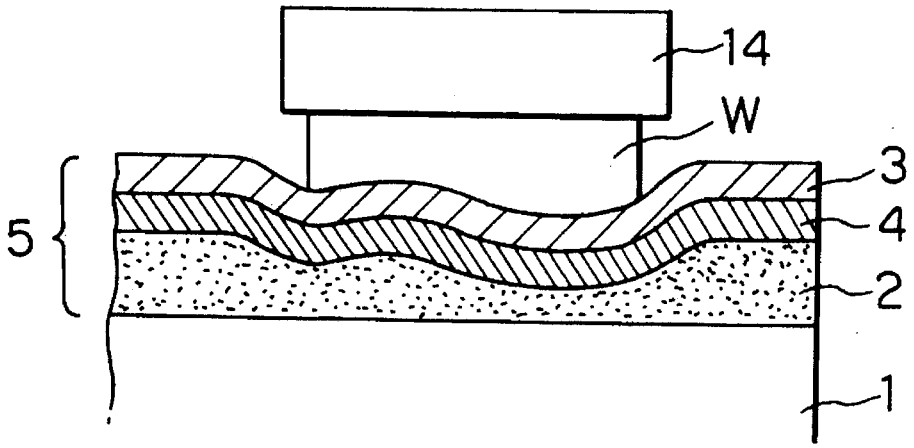
FIG. 4 is an explanatory cross section illustrating the action of the wafer polishing apparatus of FIG. 3.

The wafer polishing apparatus recited in the sixth aspect of this invention is so constructed as to have attached fast to the polishing table 1 the polishing member 5 formed by superposing the foam sheet 2, a flexible sheetlike member 4 made of a thin sheet of hard plastic material and so on, and the polishing cloth 3 sequentially in the order mentioned as illustrated in FIG. 4. When the wafer W is pressed down by the pressing member 14, therefore, it can be polished with the polishing pressure distributed uniformly throughout the entire rear surface of the wafer and the polishing member 5 bent in conformity with the global rises and falls of the wafer surface.

Figure 5:
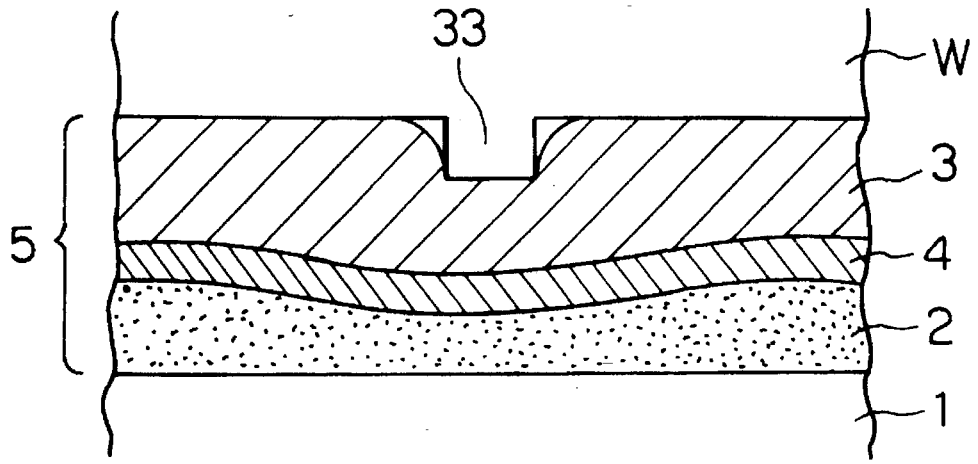
FIG. 5 is a diagram illustrating part of the diagram of FIG. 4 in a magnified scale.
Figure 6:
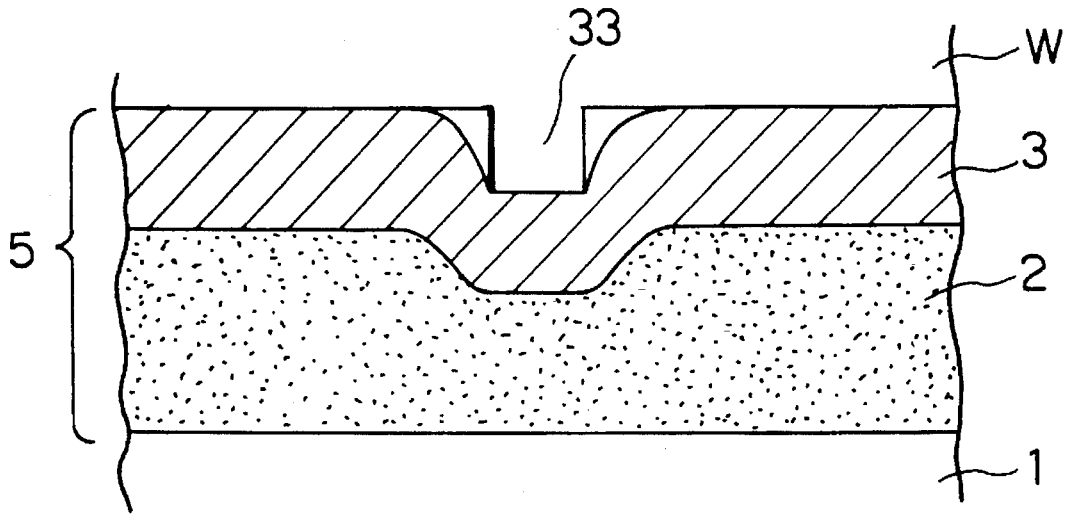
FIG. 6 is an explanatory cross section illustrating the action of a wafer polishing apparatus using no flexible sheetlike member.

In the absence of the interposed flexible sheetlike member, the influence of the protrusions 33 of oxide film finds its outlet in the foam sheet 2 as shown in FIG. 6 on account of the flexibility of the polishing cloth 3 and the force is not easily exerted on these protrusions 33 of oxide film. In the case of the construction contemplated by this invention, the flexible sheetlike member 4 has the nature of being deformed with a large radius of curvature instead of being locally deformed, though the upper layer of the polishing cloth 3 is deformed as convexed (deformed locally) in a size approximating closely the size of the protrusions 33 of oxide film as shown in FIG. 5. Thus,the flexible sheetlike member 4 is deformed in such a manner as to disperse the deformation of the polishing cloth 3 in the neighboring area, the force is readily concentrated on the protrusions of oxide film, and the protrusions of oxide film are flattened with ease.

The wafer polishing apparatus of this invention is capable of readily flattening the protrusions of oxide film while keeping the uniformity of thickness of the oxide film as described above.

Now, this invention will be described more specifically below with reference to working examples illustrated in the annexed drawings.

EXAMPLE 1

FIG. 1 is a cross section schematically illustrating the essential part of a polishing apparatus. A foam sheet 2 made of soft rubbery elastomer is attached fast to the surface of a polishing table 1 and a well-known polishing cloth 3 of the suede type, the velour type and the like is superposed fast on the foam sheet 2. A sheetlike polishing member 5 is composed of the foam sheet 2 and the polishing cloth 3. A device 11 for retaining and rotating a wafer W comprises a vertically reciprocating rotating shaft 13 furnished therein with a vacuum flow path 12 and provided in the lower end part thereof with a pressing member 14 made of a hard material, a vacuum suction plate 15 disposed in the lower end part of the pressing member 14, and a template 16 disposed on the outer peripheral side of the suction plate. The vacuum flow path is made to communicate with the suction hole of the vacuum suction plate 15.

Desirably, the polishing member 5 is preparatorily obtained by laminating the foam sheet 2 and the polishing cloth 3 and this polishing member 5 is subsequently attached through the medium of the foam sheet 2 to the polishing table 1. This procedure, as compared with a procedure which comprises first attaching the foam sheet 2 to the surface of the polishing table 1 and then joining the polishing cloth 3 thereto, facilitates the work of attachment of the polishing member 5, appreciably represses the occurrence of wrinkles in the polishing member 5, and permits the object of this invention to be attained faithfully.

EXAMPLE 2

Figure 3:
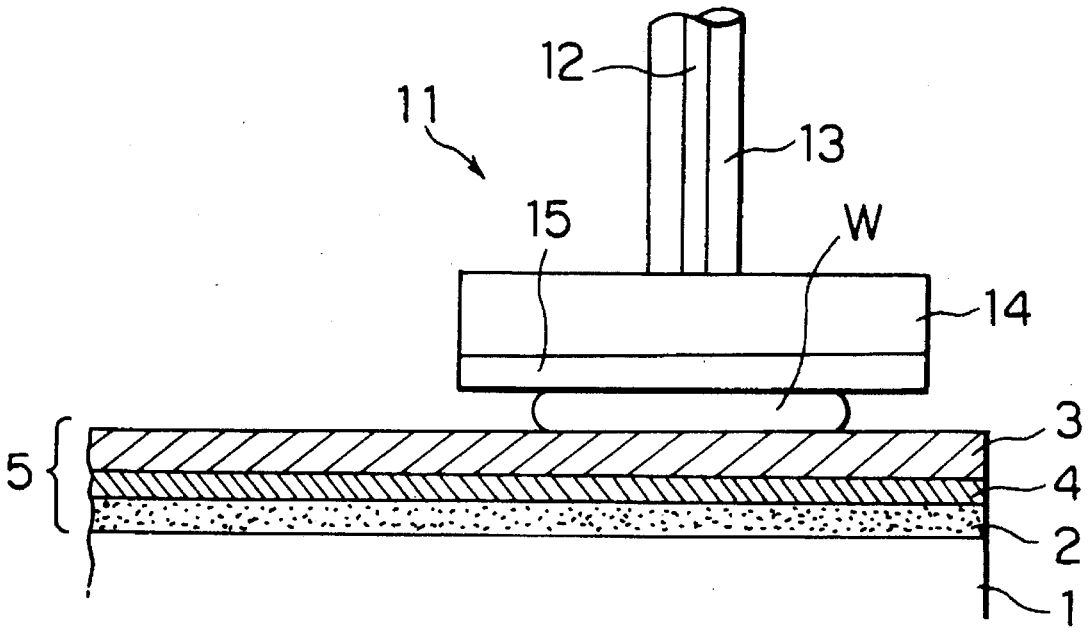
FIG. 3 is a cross section schematically illustrating the essential part of another example of the wafer polishing apparatus according to this invention.

FIG. 3 is a cross section schematically illustrating the essential part of a polishing apparatus. In this apparatus, a sheetlike polishing member 5 is constructed by attaching a foam sheet 2 made of soft rubbery elastomer to the surface of a polishing table 1, superposing a flexible sheetlike member 4 of a thin sheet of epoxy resin reinforced with glass fibers on the foam sheet 2, and further superposing a well-known polishing cloth 3 of the suede type, the velour type and the like on the flexible sheetlike member 4.

A device 11 for retaining and rotating a wafer W comprises a vertically reciprocating rotating shaft 13 furnished therein with a vacuum flow path 12 and provided in the lower end part thereof with a pressing member 14 made of a hard material, and a vacuum suction plate 15 disposed in,the lower end part of the pressing member 14. The vacuum flow path is made to communicate with the suction hole of the vacuum suction plate 15.

Desirably, the polishing member 5 is preparatorily obtained by laminating the foam sheet 2, the flexible sheetlike member 4, and the polishing cloth 3 and this polishing member 5 is subsequently attached through the medium of the foam sheet 2 to the polishing table 1. This procedure, as compared with a procedure which comprises sequentially attaching the foam sheet 2 and other parts to the surface of the polishing table 1, facilitates the work of attachment of the polishing member 5, appreciably represses the occurrence of wrinkles in the polishing member 5, and permits the object of this invention to be attained faithfully.

The flexible sheetlike member 4 and the foam sheet 2 may be kept attached at all times to the polishing table 1 and only the polishing cloth 3 may be replaced with a new supply. This measure permits a saving of the cost of the polishing member 5.

Now, test examples of the use of the polishing apparatus of the present invention and comparative examples of the use of a conventional polishing apparatus will be cited below.

TEST EXAMPLE 1

Figure 7:
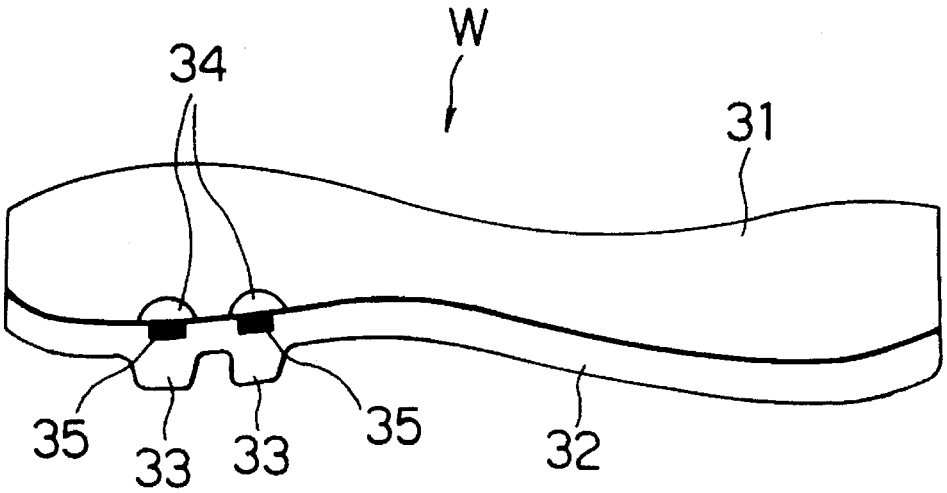
FIG. 7 is a cross section illustrating a wafer yet to be polished.
Figure 8:
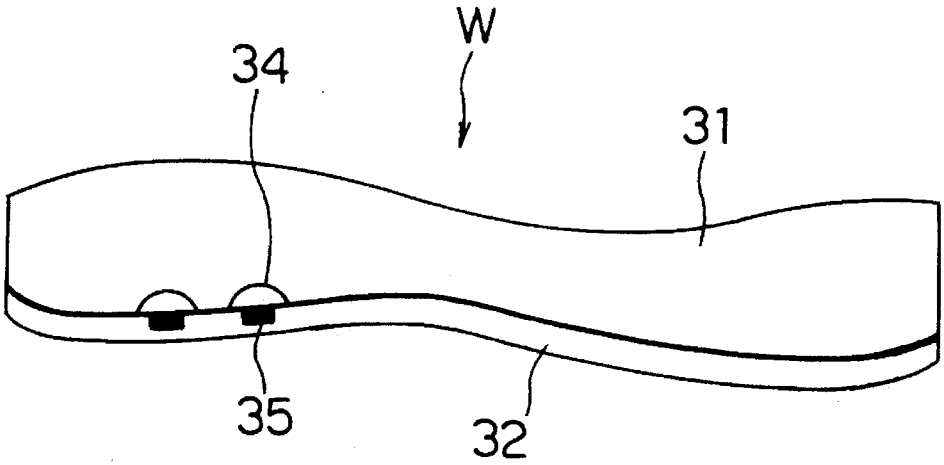
FIG. 8 is a cross section illustrating the wafer after being polished.

With a polishing member of the construction indicated below attached to a polishing table 1 as illustrated in FIG. 1, a silicon wafer W having a cross-sectional shape shown in FIG. 7 and measuring about 660 μm in thickness and 150 mm in diameter (produced by superposing a thermal oxide film in a thickness of 1.2 μm on the surface of a silicon substrate with mirror surface) was polished under ordinary conditions by the use of colloidal silica as abrasive. The cross-sectional shapes of the wafer before and after the polishing were compared.

[Polishing member]

Foam sheet:

| | |
|---|---|
| Material | Chloroprene rubber |
| Thickness | 0.8 mm |
| Specific gravity | 0.23 |
| Cell diameter | 0.05 to 0.16 mm (measured with an electron microscope) |
| Cell content | About 80% |

-continued

| | |
|---|---|
| Compressive elastic modulus | 60 g/mm$^2$ before use<br>12 g/mm$^2$ after use |
| Polishing cloth, velour type (non-woven fabric): | |
| Thickness | 1.27 mm |
| [Polishing conditions] | |
| Polishing pressure 500 gf/cm$^2$ | |
| Relative speed | 110 m/min (between polishing member and wafer) |
| Polishing time | 30 minutes |

Figure 9:
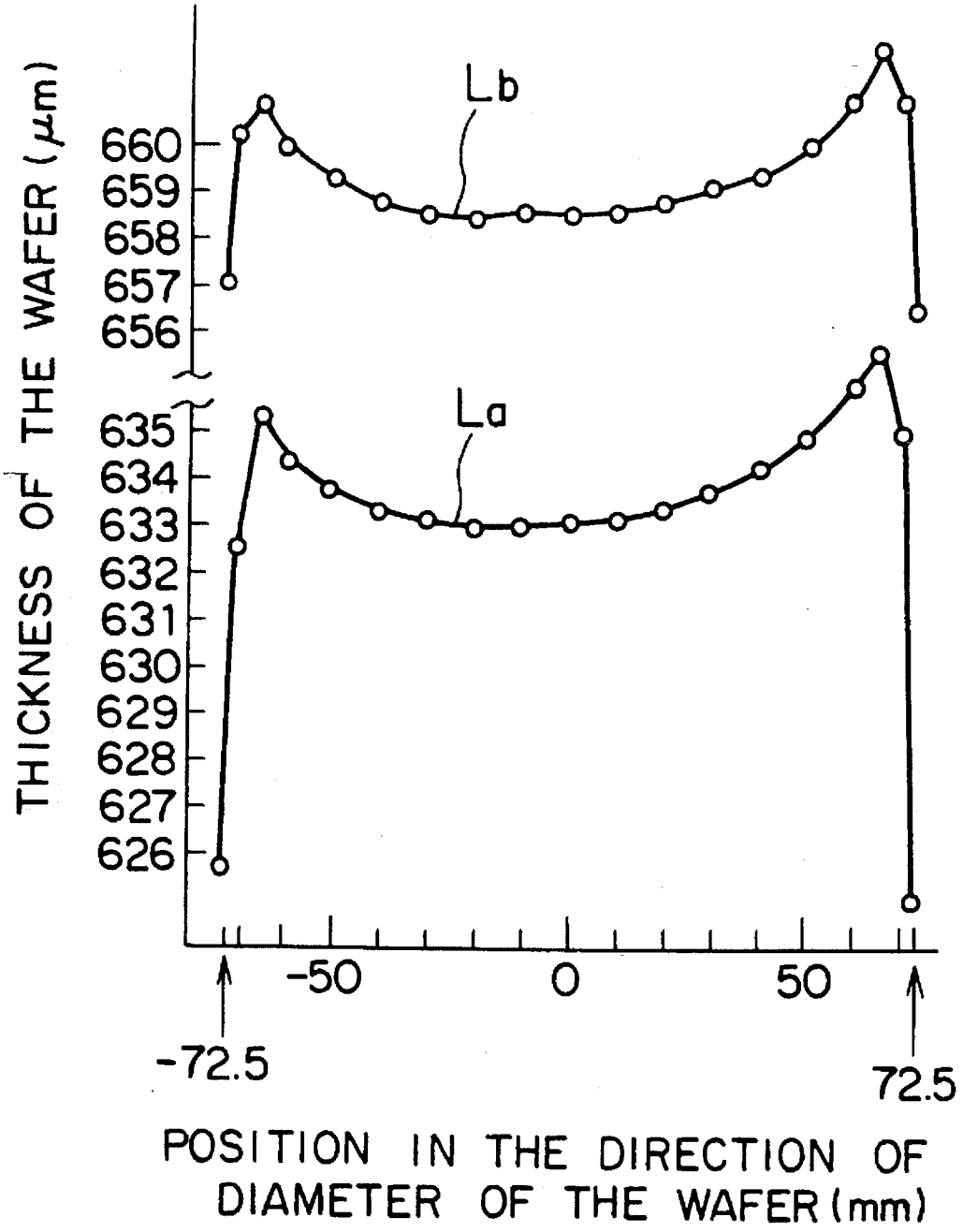
FIG. 9 is a graph showing the results of Test Example 1 of this invention.

The results of the polishing are shown in FIG. 9. In the diagram, the curve Lb represents the relation between the position in the direction of diameter and the thickness of the wafer before the polishing and the curve La the same relation of the wafer after the polishing. The thickness of the wafer was measured with an electron micrometer.

It is clearly remarked by comparing the curves Lb and La that the wafer containing global rises and falls in the surface before the polishing could be polished with the global rises and falls left intact in shape and size. Thus, according to this invention, even a wafer having a dispersed wall thickness can be polished without impairing the cross-sectional shape thereof, indicating that the wafer surface can be uniformly removed throughout the entire area thereof. In other words, when the thermal oxide film is formed in a uniform thickness on the surface of a silicon substrate having a dispersed wall thickness, the surface-based polishing capable of maintaining the uniformity of the thermal oxide film thickness can be infallibly carried out by the present invention.

The diagram of FIG. 9 depicts that the polishing caused the wafer to produce a sag in the outermost peripheral part thereof and sustain slight disfigurement. These defects pose no problem because the above area of the wafer containing these defects are not meant for use. The sag can be eliminated by a suitable technique not dealt with in this specification. The present example adopts the vacuum suction plate 15 made of hard material as means to fix the wafer. It has been ascertained that the fixation of the wafer can be obtained similarly effectively by adopting the mounting pad-template method.

COMPARATIVE EXAMPLE 1

Figure 10:
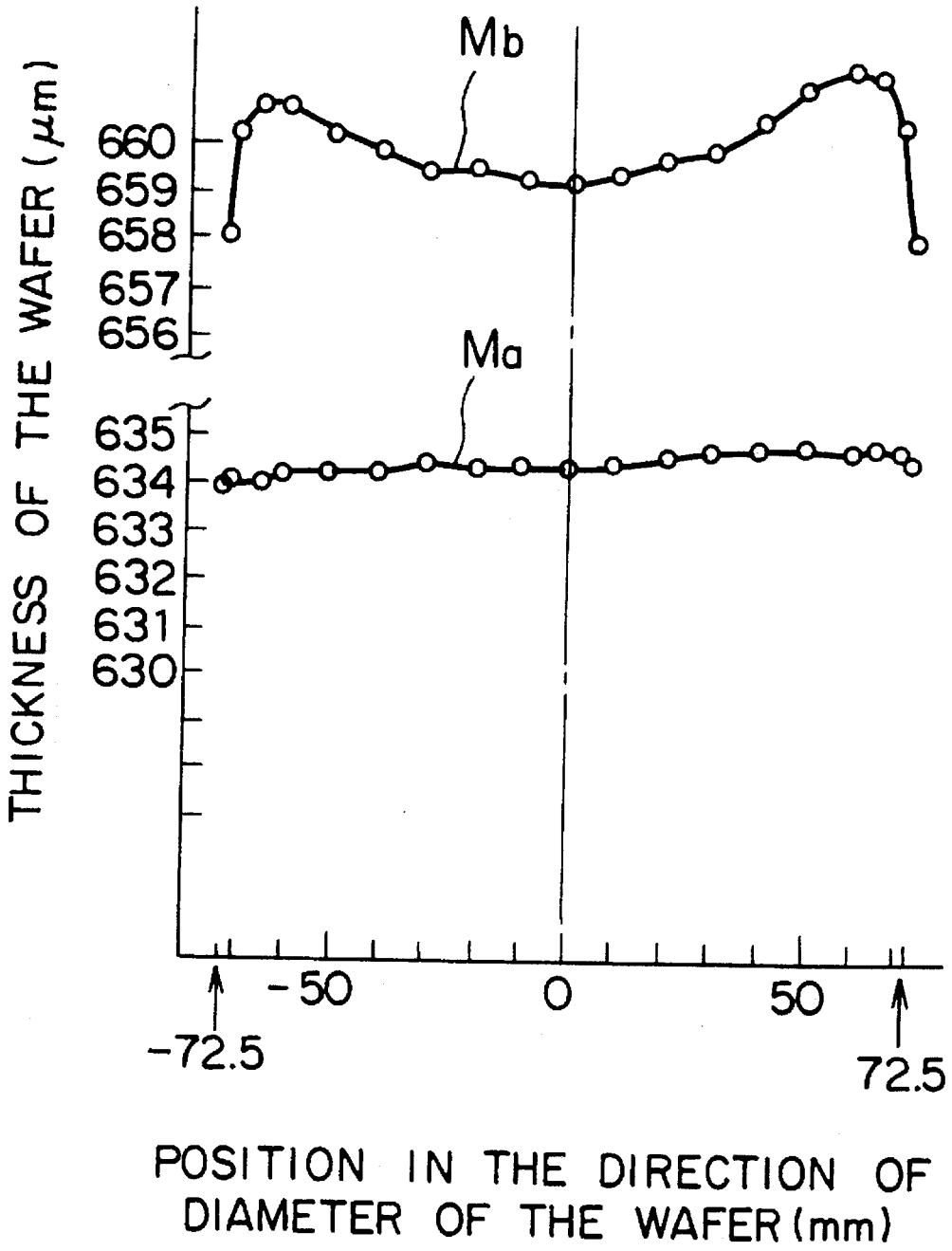
FIG. 10 is a graph showing the results of Comparative Example 1.

A test polishing was carried out by following the procedure of Test Example 1 while using the polishing cloth of Test Example 1 exclusively as a polishing . member. The results of this polishing are shown in FIG. 10. In this diagram, the curve Mb represents the relation between the position in the direction of diameter and the thickness of the wafer before the polishing and the curve Ma the same relation of the wafer after the polishing.

It is clearly noted by comparing the curves Mb and Ma that the global rises and falls existing in the wafer before the polishing were totally absent after the polishing, indicating that the polishing obtained uniform removal of the wafer surface throughout the entire area thereof with difficulty.

TEST EXAMPLE 2

With a polishing member of the construction indicated below attached to a polishing table 1 as illustrated in FIG. 3, a silicon wafer W having a cross-sectional shape shown in FIG. 7 and measuring about 660 μm in thickness and 150 mm in diameter (produced by superposing a thermal oxide film in a thickness of 1.3 μm on the surface of a silicon substrate with mirror surface) was mirror polished under ordinary conditions by the use of fumed silica abrasive (marketed under trademark designation of "Semisperse TM-25"). The cross-sectional shapes of the wafer before and after the polishing were compared.

| | |
|---|---|
| [Polishing member] | |
| Foam sheet: | |
| Material | Chloroprene rubber |
| Thickness | 0.8 mm |
| Specific gravity | 0.23 |
| Cell diameter | 0.05 to 0.16 mm (measured with an electron microscope) |
| Cell content | About 80% |
| Compressive elastic modulus | 60 g/mm$^2$ before use<br>12 g/mm$^2$ after use |
| Flexible sheetlike member: | |
| Material | Epoxy resin sheet containing glass fibbers |
| Thickness | 0.3 mm |
| Polishing cloth, velour type (non-woven fabric for the use of primary polishing): | |
| Thickness | 1.27 mm |
| [Polishing conditions] | |
| Polishing pressure | 300 gf/cm$^2$ |
| Relative speed | 80 m/min (between polishing member and wafer) |
| Polishing time | 30 minutes |

Figure 11:
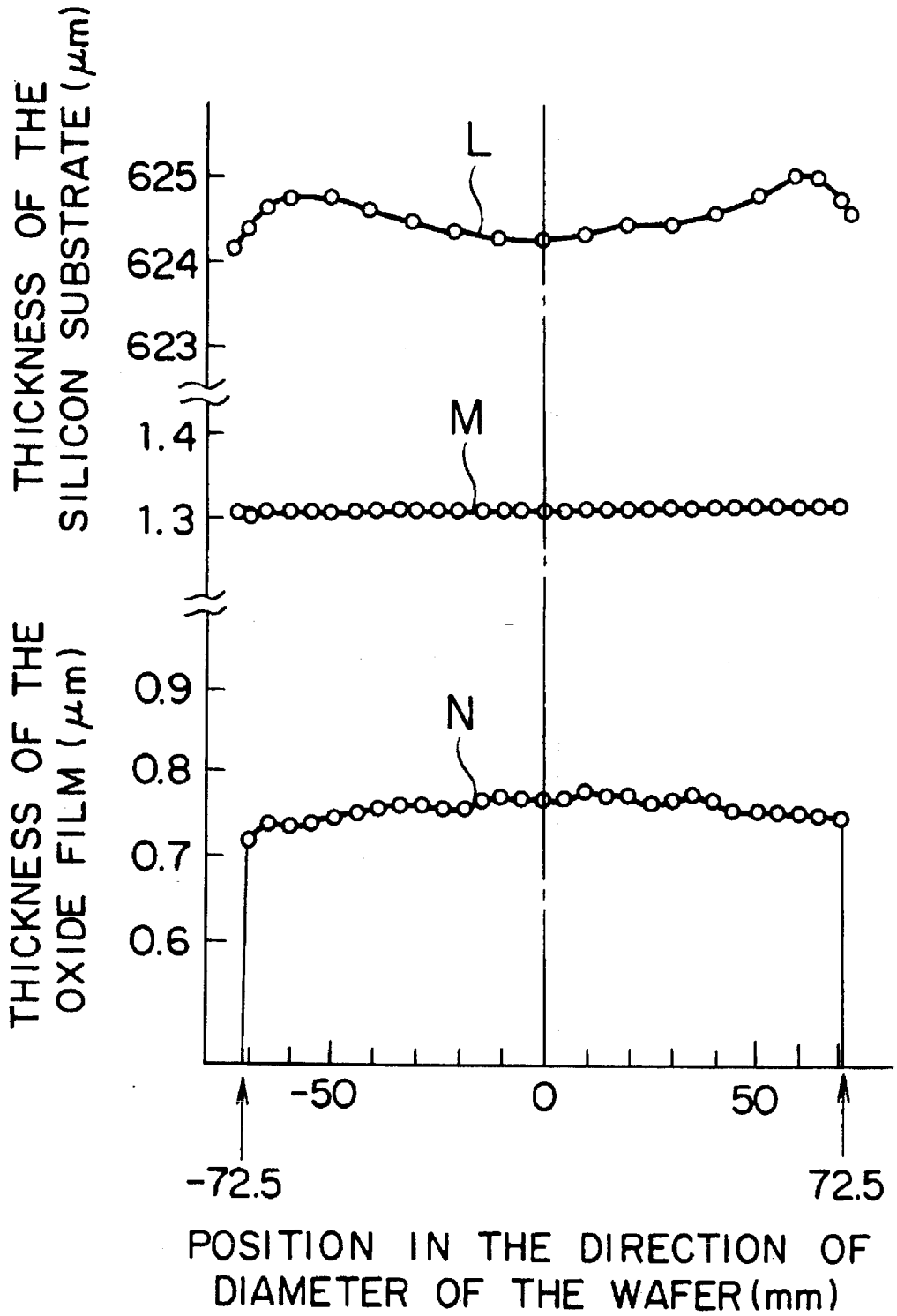
FIG. 11 is a graph showing the results of Test Example 2 of this invention.

The results of the polishing are shown in FIG. 11. In the diagram, the curve L represents the relation between the position in the direction of diameter and the thickness of the silicon substrate of the wafer before the polishing, the curve M represents the relation between the position in the direction of diameter and the thickness of the oxide film of the wafer after the polishing, and the curve N represents the same relation as the relation represented by the curve M of the wafer after the polishing. The thickness of the wafer was measured with an ellipsometer.

It is clearly remarked by comparing these curves that the wafer using a silicon substrate of dispersed thickness before the polishing was polished with substantially uniform removal of the wafer surface throughout the entire area thereof. In other words, when the oxide film is formed in a uniform thickness on the surface of a silicon substrate having a dispersed wall thickness, the surface-based polishing capable of maintaining the uniformity of the oxide film thickness can be infallibly carried out by the present invention.

The present example adopts the vacuum suction plate 15 made of hard material as means to fix the wafer. It has been ascertained that the fixation of the wafer can be obtained similarly effectively by adopting the mounting pad-template method.

COMPARATIVE EXAMPLE 2

Figure 12:
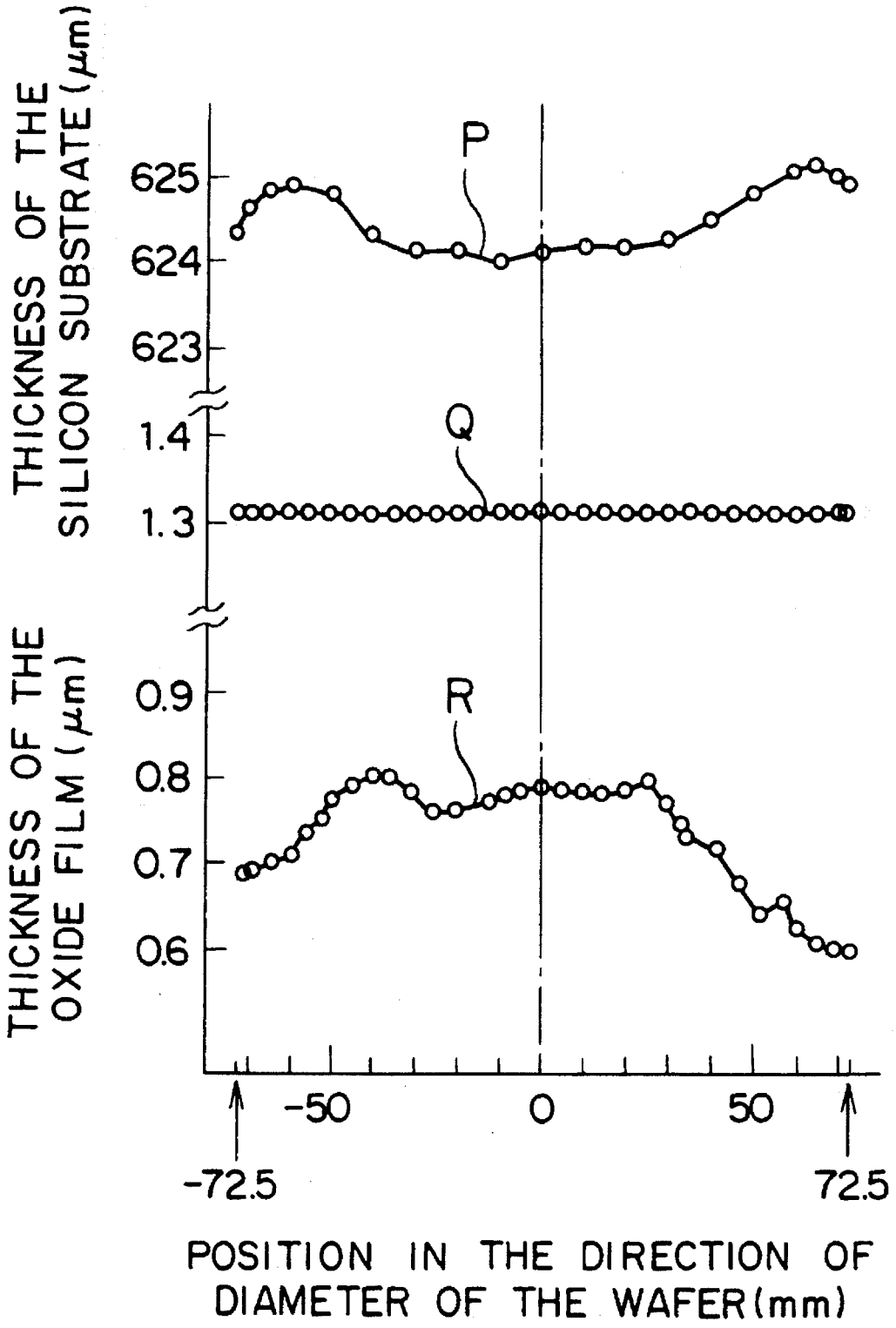
FIG. 12 is a graph showing the results of Comparative Example 2.
Figure 13:
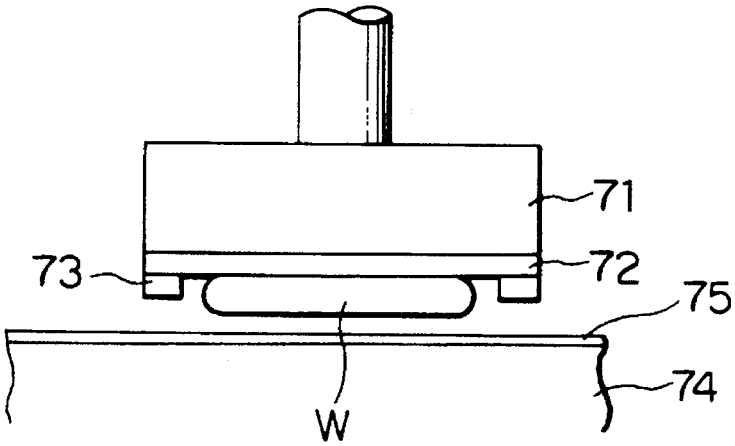
FIG. 13 is a cross section schematically illustrating the essential part of a typical conventional wafer polishing apparatus.
Figure 14:
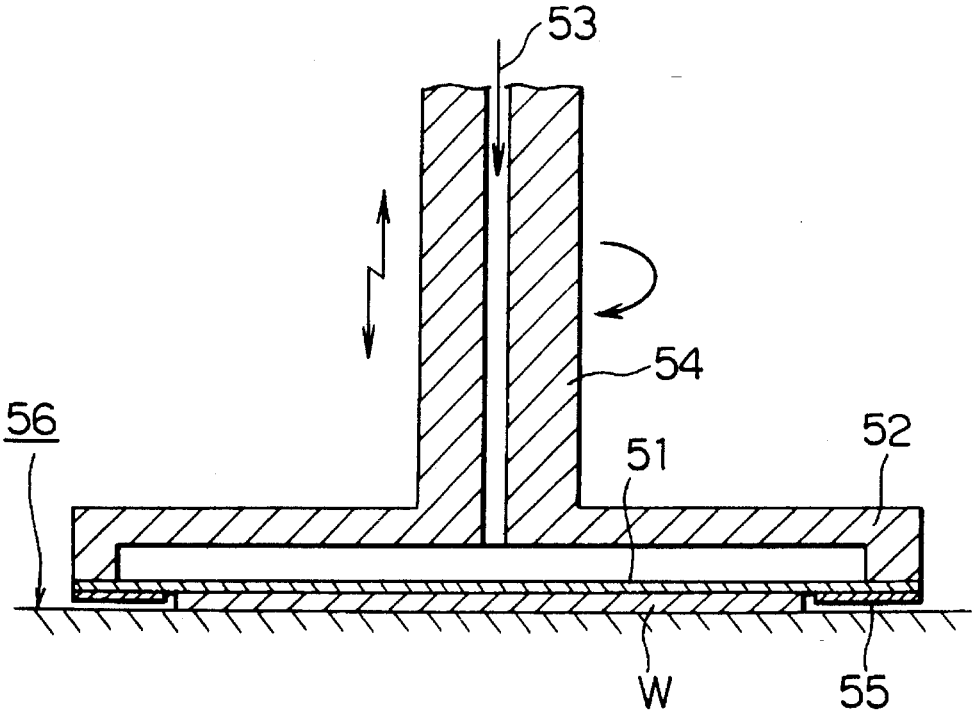
FIG. 14 is a cross section schematically illustrating the essential part of another typical conventional wafer polishing apparatus.
Figure 15:
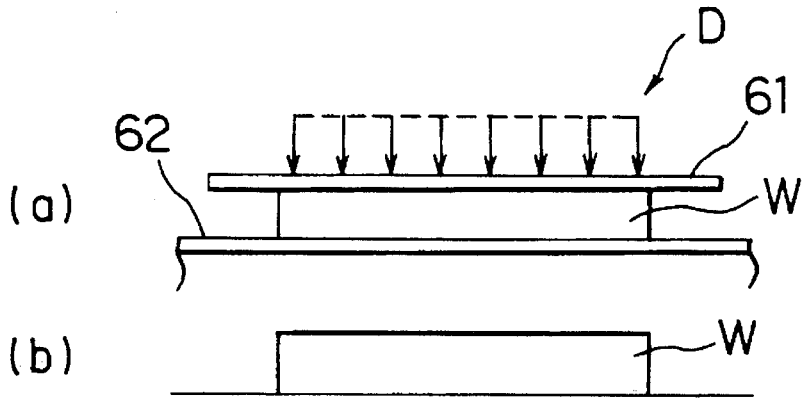
FIG. 15 illustrates a preferred condition of polishing, (a) an explanatory diagram of the distribution of polishing pressure and (b) a cross section illustrating a polished wafer.
Figure 16:
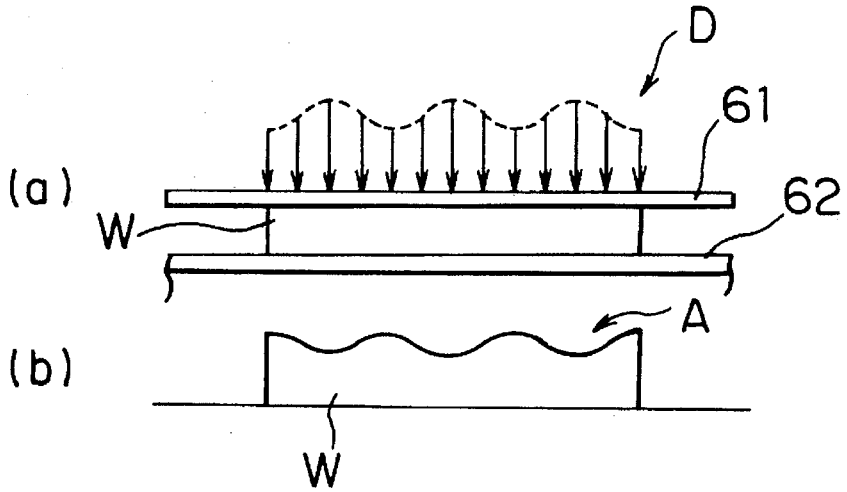
FIG. 16 illustrates one example of undesirable condition of polishing, (a) an explanatory diagram of the distribution of polishing pressure and (b) a cross section illustrating a polished wafer.
Figure 17:
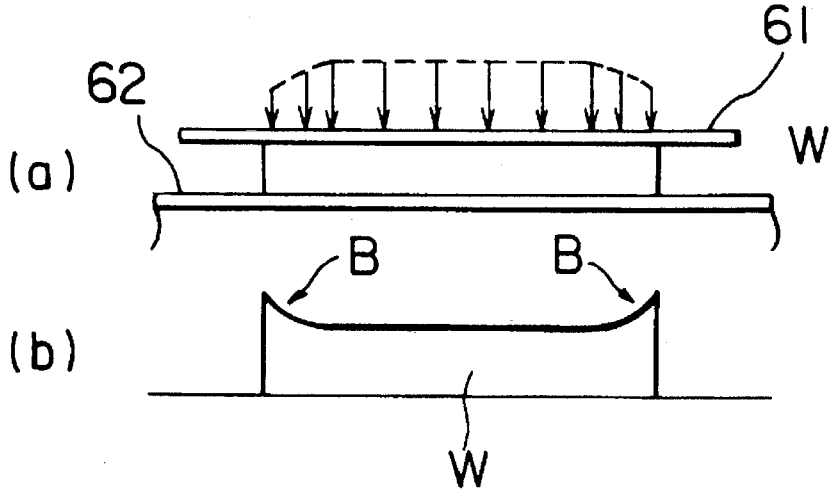
FIG. 17 illustrates another example of undesirable condition of polishing, (a) an explanatory diagram of the distribution of polishing pressure and (b) a cross section illustrating a polished wafer.
Figure 18:
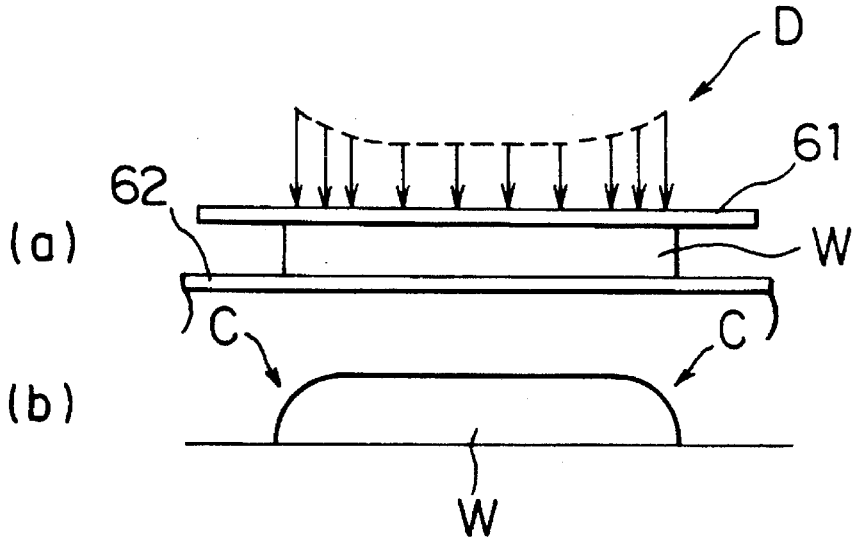
FIG. 18 illustrates yet another example of undesirable condition of polishing, (a) an explanatory diagram of the distribution of polishing pressure and (b) a cross section illustrating a polished wafer.

A test polishing was carried out by following the procedure of Test Example 2 while using the polishing cloth of Test Example 2 exclusively as a polishing member. The results of this polishing are shown in FIG. 12. In this diagram, the curve P, Q, and R respectively correspond to the curves L, M, and N of FIG. 11.

It is clearly remarked by comparing the curves Q and R that while the oxide film of the wafer had a uniform thickness before the polishing, it showed a heavy dispersion of thickness after the polishing. This fact indicates that the polishing could not be obtained while maintaining the uniformity of thickness of the oxide film.

TEST EXAMPLE 3

A test polishing was carried out by faithfully following the procedure of Test Example 1 while using a silicon wafer measuring about 660 μm in thickness and 150 mm in diameter and having mirror finish, forming linear protuberances 100 μm in width and 1 μm in height formed on the surface of the silicon wafer, having an oxide film 3 μm in thickness superposed by normal-pressure CVD further thereon, and using a polishing time of 5 minutes.

As a result, the polishing could flatten the linear protuberances to a height of 0.1 μm. In the absence of the flexible sheetlike member, the height of the linear protuberances after the polishing was 0.3 μm. The results clearly indicate that the flexible sheetlike member is effective in the implementation of this invention.

The height of the linear protuberances was measured with a contact type surface roughness tester.

It is clearly noted from the explanation made thus far that the wafer polishing apparatus recited in the fifth aspect of this invention can polish a given wafer by removing uniformly the wafer surface throughout the entire area thereof with the polishing pressure uniformly distributed throughout the entire rear surface of the wafer and the polishing member bent in conformity with the global rises and falls of the wafer surface. Even when an oxide film formed in a uniform thickness on a silicon substrate having a dispersed wall thickness is polished, therefore, this wafer polishing apparatus brings about the effect of implementing desired polishing while keeping the uniformity of the thickness of the oxide film intact.

A wafer polishing apparatus recited in the sixth aspect of this invetion is so constructed as to have attached fast to a polishing table a polishing member formed by sequentially superposing a foam sheet, a flexible sheetlike member of a thin sheet made of hard rubber for example, and a polishing cloth in the order mentioned. It, therefore, polishes a given wafer by uniformly removing the wafer surface throughout the entire area thereof with the polishing pressure distributed uniformly throughout the entire rear surface of the wafer and the polishing member bent in conformity with the Global rises and falls of the wafer surface. Even when an oxide film formed in a uniform thickness on a silicon substrate having dispersed wall thickness, this wafer polishing apparatus brings about the effect of infallibly implementing the surface-based polishing capable of keeping the uniformity of the thickness of the oxide film intact. Moreover, since the flexible sheetlike 23 member is deformed in such a manner as to disperse the deformation of the polishing cloth in the neighboring area and the force can be concentrated on the protrusions of oxide film, this polishing apparatus brings about the effect of enhancing the flattening action.

What is claimed is:

1. A polishing member disposed on a polishing table, having a foam sheet of soft rubbery elastomer and a laminated polishing cloth; and wherein said foam sheet is a closed-cell foam which is made of natural rubber, synthetic rubber, or thermoplastic elastomer and vested with flexibility by gas in cells thereof and said foam sheet has (1) a thickness in a range of 0.2 to 2 mm, (2) a cell diameter in a range of 0.05 to 1 mm, (3) a cell content (ratio of total volume of cells to total volume of the foam sheet) in a range of 70 to 98%, . . . and (4) a compressive elastic modulus in a range of 10 to 100 g/mm$^2$.

2. A polishing member according to claim 1, wherein said polishing cloth is a suede type or velour type.

3. A polishing member disposed on a polishing table, characterized by having a flexible sheet member of a hard thin sheet interposed between a foam sheet of soft rubbery elastomer and a polishing cloth; and wherein said foam sheet is a closed-cell foam which is made of natural rubber, synthetic rubber, or thermoplastic elastomer and vested with flexibility by gas in cells thereof and said foam sheet has (1) a thickness in a range of 0.2 to 2 mm, (2) a cell diameter in a range of 0.05 to 1 mm, (3) a cell content (ratio of total volume of cells to total volume of the foam sheet) in a range of 70 to 98%, and (4) a compressive elastic modulus in a range of 10 to 100 g/mm$^2$.

4. A polishing member according to claim 3, wherein said polishing cloth is a suede type or velour type.

5. A wafer polishing apparatus, characterized by having a foam sheet of soft rubbery elastomer superposed fast on the surface of a polishing table and having a polishing cloth laminated on said foam sheet; and wherein said foam sheet is a closed-cell foam which is made of natural rubber, synthetic rubber, or thermoplastic elastomer and vested with flexibility by gas in cells thereof and said foam sheet has (1) a thickness in a range of 0.2 to 2 mm, (2) a cell diameter in a range of 0.05 to 1 mm, (3) a cell content (ratio of the total volume of cells to total volume of the foam sheet) in a range of 70 to 98%, and (4) a compressive elastic modulus in a range of 10 to 100 g/mm$^2$.

6. A wafer polishing apparatus according to claim 5, wherein said polishing cloth is a suede type or velour type.

7. A wafer polishing apparatus, characterized by having a foam sheet of soft rubbery elastomer superposed fast on the surface of a polishing table, having a flexible sheet member of hard thin sheet laminated on said foam sheet, and having a polishing cloth laminated on said flexible sheet member; and wherein said foam sheet is a closed-cell foam which is made of natural rubber, synthetic rubber, or thermoplastic elastomer and vested with flexibility by gas in cells thereof and said foam sheet has (1) a thickness in a range of 0.2 to 2 mm, (2) a cell diameter in a range of 0.05 to 1 mm, (3) a cell content (ratio of the total volume of cells to total volume of the foam sheet) in a range of 70 to 98%, and (4) a compressive elastic modulus in a range of from 10 to 100 g/mm$^2$.

8. A wafer polishing apparatus according to claim 7, wherein said polishing cloth is a suede type or velour type.

* * * * *